US007599652B2

(12) United States Patent
Takagami

(10) Patent No.: US 7,599,652 B2
(45) Date of Patent: Oct. 6, 2009

(54) IMAGE FORMING APPARATUS WITH STATIC CHARGE ELIMINATOR FOR DISCHARGING AN ELECTRIC CHARGE ON A TRANSFER SHEET

(75) Inventor: Ai Takagami, Osaka (JP)

(73) Assignee: Kyocera Mita Corporation (JP)

( * ) Notice: Subject to any disclaimer, the term of this patent is extended or adjusted under 35 U.S.C. 154(b) by 71 days.

(21) Appl. No.: 11/880,810

(22) Filed: Jul. 24, 2007

(65) Prior Publication Data

US 2008/0025767 A1 Jan. 31, 2008

(30) Foreign Application Priority Data

Jul. 26, 2006 (JP) ..... 2006-203391

(51) Int. Cl.
*G03G 15/14* (2006.01)

(52) U.S. Cl. ..... 399/315; 399/398

(58) Field of Classification Search ..... 399/313, 399/315, 398
See application file for complete search history.

(56) References Cited

U.S. PATENT DOCUMENTS 5,073,801 A * 12/1991 Haneda et al. ..... 399/45
5,294,962 A * 3/1994 Sato et al. ..... 399/175
6,097,924 A * 8/2000 Okuyama ..... 399/315

FOREIGN PATENT DOCUMENTS

JP 63092978 A * 4/1988
JP 4-12382 1/1992
JP 04034481 A * 2/1992
JP 6-194966 7/1994
JP 10-282799 10/1998

* cited by examiner

*Primary Examiner*—David M Gray
*Assistant Examiner*—Bryan P Ready
(74) *Attorney, Agent, or Firm*—Gerald E. Hespos; Anthony J. Casella

(57) ABSTRACT

An image forming apparatus comprises: a revolving image bearing member on which a toner image is formed; a transfer member that is provided at a position facing the surface of the image bearing member and transferring the toner image electrostatically on a transfer sheet traveling between the image bearing member and the transfer member; a static charge eliminator generating an electric field for discharging the electric charge on the transfer sheet for separation of the transfer sheet carrying the transferred toner image from the image bearing member; and a conductive member that is provided between the static charge eliminator and the transfer member.

21 Claims, 7 Drawing Sheets

IMAGE FORMING APPARATUS WITH STATIC CHARGE ELIMINATOR FOR DISCHARGING AN ELECTRIC CHARGE ON A TRANSFER SHEET

BACKGROUND OF THE INVENTION

1. Field of the Invention

The present invention relates to an image forming apparatus transferring a toner image on a transfer sheet, and in particular, to improvement of an electrostatic charge eliminator for discharge of the transfer sheet after transfer.

2. Description of the Related Art

Image forming apparatuses normally have a basic configuration consisting of a photosensitive drum (image bearing member) driven to rotate around its shaft center, and an electrostatic charger, an exposure device, a developing device, a transfer member and a cleaning device provided around it.

The photosensitive drum is driven to revolve around its shaft center, and the peripheral surface of the photosensitive drum is charged uniformly by application of high voltage from the electrostatic charger. An electrostatic latent image is then formed on the peripheral surface by irradiation of the light emitted from the exposure device, based on the image information, onto the peripheral surface of the uniformly charged photosensitive drum. Toner particles are then supplied from the developing device onto the peripheral surface of the photosensitive drum carrying the electrostatic latent image forming a toner image corresponding to the electrostatic latent image on the same peripheral surface. The toner image is charged, for example, positively.

The toner image formed on the peripheral surface of photosensitive drum as it is charged positively reaches the position of the transfer member by revolution of the photosensitive drum. When the transfer sheet is fed into a nip portion between the photosensitive drum and the transfer member, negative electric charge is applied to the transfer sheet from the transfer member, and the toner image is transferred onto the transfer sheet by the electrostatic attractive force. The transfer sheet after transfer is fixed under heat in the fixing device and discharged out of the apparatus.

The transfer sheet after transfer processing occasionally adhere to the revolving photosensitive drum, because the toner image may not be separated easily from the peripheral surface of the photosensitive drum, which leads to a trouble of the transfer sheet not being conveyed to the fixing device. Such a trouble, which often occurs under low-temperature and low-humidity environment, leads also to staining of the transfer sheet.

To prevent such a trouble, the image forming apparatus disclosed in Japanese Patent Unexamined Publication No. 4-12382 (D1) has charge-eliminating teeth that may be brought into the electrically floating state (electrically floating neutral state without grounding or voltage application) at a position close to the region between the photosensitive drum and the transfer member facing each other. The apparatus disclosed in D1 has an additional control means of controlling the electric current supplied to the transfer member, and conducts the transfer processing smoothly by properly controlling the state of the charge-eliminating teeth and the electric current supplied to the transfer member.

In addition, the image forming apparatus disclosed in Japanese Patent Unexamined Publication No. 6-194966 (D2) has charge-eliminating teeth with the edge facing the position between the photosensitive drum and the transfer member facing each other, and thus, improves the action by the charge-eliminating teeth of separating the toner image form the photosensitive drum.

Further, the image forming apparatus disclosed in Japanese Patent Unexamined Publication No. 10-282799 (D3) has charge-eliminating teeth with the edge facing the position between a photosensitive drum and a transfer member facing each other and a barrier of an insulating material provided between the transfer member and the charge-eliminating teeth. In the apparatus disclosed in D3, short circuiting between the charge-eliminating teeth and the transfer member is prevented by the barrier, and thus, the toner image-separating efficiency of the charge-eliminating teeth is improved.

However, the apparatus disclosed in D1 demands an additional control means of controlling electric current, and thus, has a problem that the costs becomes higher.

Also in the apparatus disclosed in D2, the charge-eliminating teeth are merely provided at a position facing the position between the transfer member and the photosensitive drum facing each other. Thus, such an apparatus has a problem that the electric field formed by the charge-eliminating teeth does not always function properly to separate the toner image form the photosensitive drum peripheral surface, and the electric field does not show a desirable action because of leakage to the transfer member or the photosensitive drum.

Further, the apparatus disclosed in D3, in which a barrier of an insulating material is merely placed between the charge-eliminating teeth and the transfer member, does not give an advantageous effect as much as expected.

SUMMARY OF THE INVENTION

An object of the present invention is to provide an image forming apparatus that can prohibit adhesion of a transfer sheet to an image bearing member by discharging the transfer sheet after transfer processing reliably.

An image forming apparatus according to an aspect of the present invention, which achieves the object, comprises: a revolving image bearing member on which a toner image is formed; a transfer member that is provided at a position facing the surface of the image bearing member and transferring the toner image electrostatically on a transfer sheet traveling between the image bearing member and the transfer member; a static charge eliminator generating an electric field for discharging the electric charge on the transfer sheet for separation of the transfer sheet carrying the transferred toner image from the image bearing member; and a conductive member that is provided between the static charge eliminator and the transfer member.

DETAILED DESCRIPTION OF THE PREFERRED EMBODIMENTS

Figure 1:
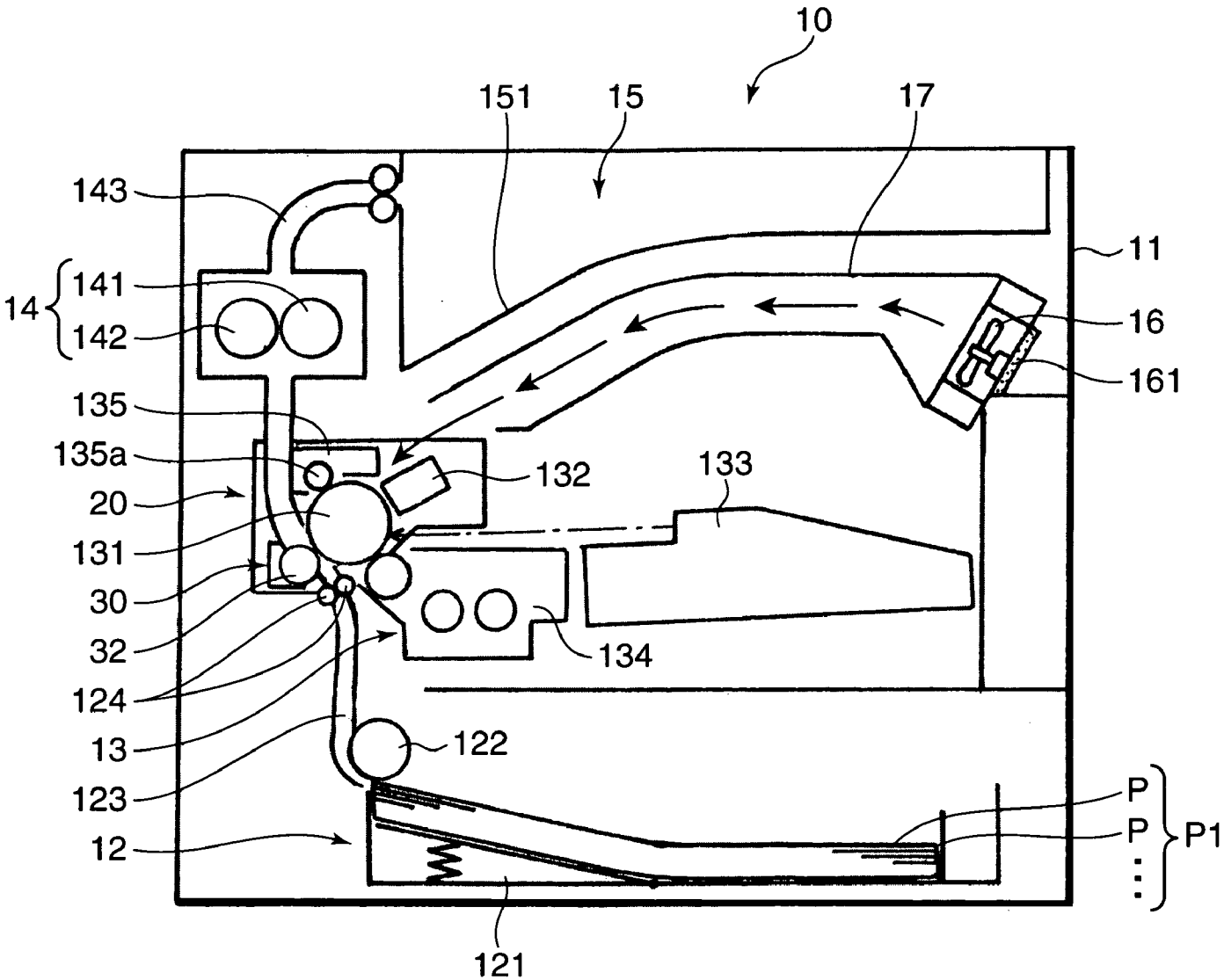
FIG. 1 is a schematic front sectional view illustrating the internal structure of a printer in an embodiment of the image forming apparatus according to the invention.

First, a printer, an example of the image forming apparatus according to the invention, will be described with reference to FIG. 1. FIG. 1 is a schematic front sectional view illustrating the internal structure of the printer in an embodiment. As shown in this Figure, the printer 10 has a sheet container 12 storing the transfer sheet P for use in printing, an image forming unit 13 transferring an image on each transfer sheet P fed from the transfer sheet bundle P1 stored in the sheet container 12, a fixing unit 14 fixing the transfer sheet P carrying the image transferred in the image forming unit 13, all of which are provided inside an apparatus housing 11, and a sheet discharge unit 15 to which the transfer sheet P fixed in the fixing unit 14 is discharged that is provided on the top of the apparatus housing 11.

A certain number (one in this embodiment) of sheet cassettes 121 are removably placed in the sheet container 12 inside the apparatus housing 11. There is a pickup roller 122 provided at the upstream terminal of the sheet cassette 121 (left in FIG. 1) that withdraws a transfer sheet P from the transfer sheet bundle P1. The transfer sheet P is withdrawn from the sheet cassette 121, as driven by the pickup roller 122, and supplied, via the sheet-supplying route 123 and a resist roller pair 124 provided downstream terminal of the sheet-supplying route 123, to the image forming unit 13.

The image forming unit 13 transfers an image on the transfer sheet P, based on image information transmitted for example from computer. The image forming unit 13 includes a photosensitive drum (image bearing member) 131 provided rotatably around a drum axis extending in the vertical direction (direction vertical to the sheet in FIG. 1). In addition, there are an electrostatically charging device 132, an exposure device 133, a developing device 134, a transfer roller 32 and a cleaning device 135 provided along the peripheral surface of the photosensitive drum 131 clockwise from the right top of the photosensitive drum 131 in FIG. 1.

In the present embodiment, the photosensitive drum 131, the electrostatically charging device 132, the cleaning device 135, and a transfer member 30 described below containing the transfer roller 32 are placed in a particular housing 21 (see FIG. 2) and integrated as a photosensitive drum unit 20. Thus, by inserting and withdrawing the housing 21 into and from the apparatus housing 11, the photosensitive drum 131, the electrostatically charging device 132, the cleaning device 135 and the transfer member 30 are all inserted and withdrawn at once to and from the apparatus housing 11. The housing 21 is integrated with the apparatus housing 11, as it is provided at a particular position in the apparatus housing 11, and thus, the housing may be regarded as part of the apparatus housing 11.

Figure 6:
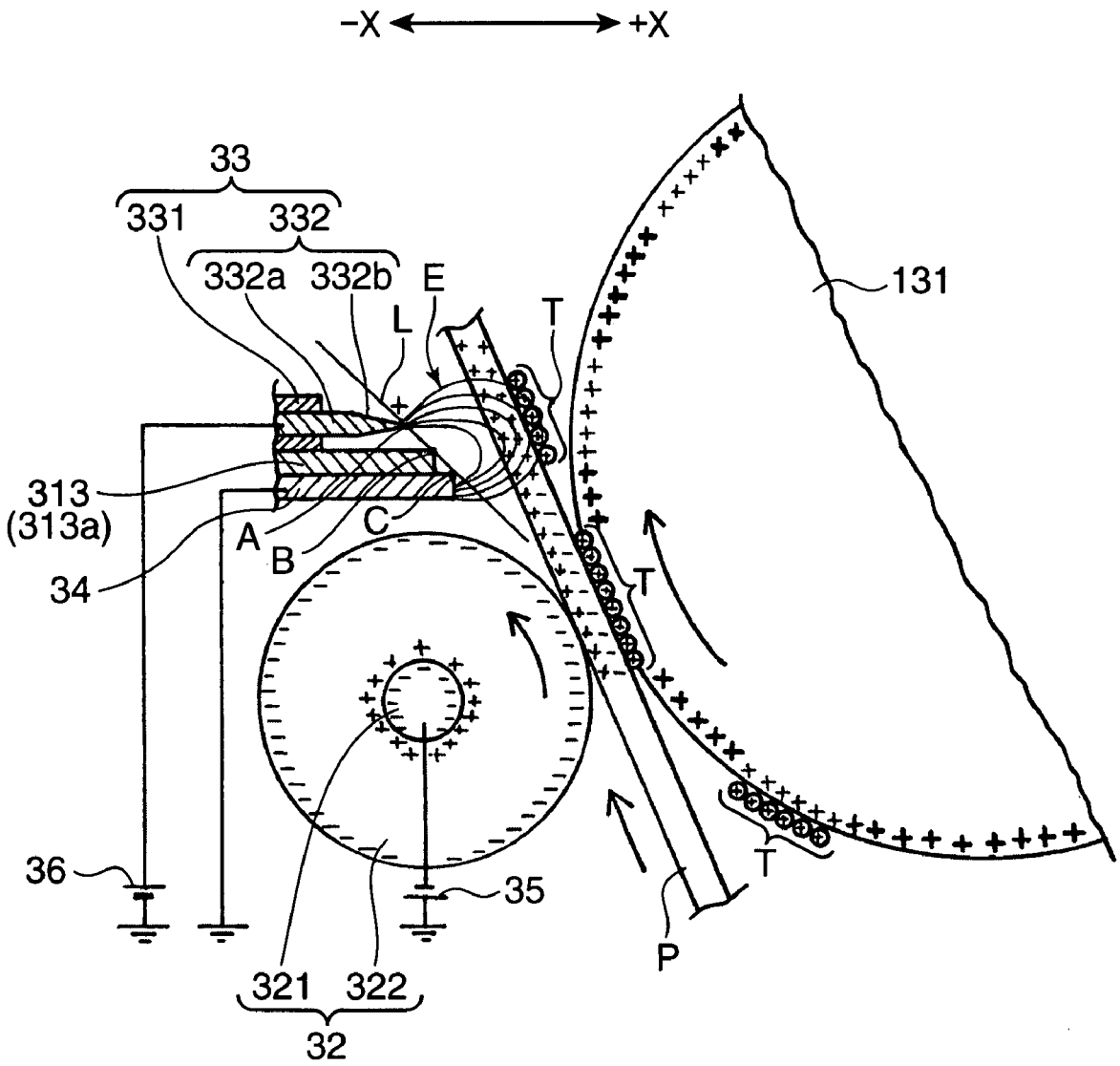
FIG. 6 is a partial expanded view of the transfer member shown in FIG. 5 explaining the action of the transfer member.

The photosensitive drum 131 allows formation of an electrostatic latent image on the peripheral surface and a toner image T along the electrostatic latent image (FIG. 6). A smooth and tough amorphous silicon layer suitable for forming an electrostatic latent image and a toner image T is formed on the peripheral surface of the photosensitive drum 131.

The electrostatically charging device 132 charges the peripheral surface of the photosensitive drum 131 uniformly, while revolving clockwise around the drum axis. The electrostatically charging device 132 applies electric charges on the peripheral surface of the photosensitive drum 131 by corona discharge.

The exposure device 133 irradiates intensity-controlled laser beam on the peripheral surface of the revolving photosensitive drum 131, based on image data transmitted from an external device such as computer. The electrostatic latent image is formed on the peripheral surface of the photosensitive drum 131 by decrease in electric charge in the region irradiated with laser beam. For example, the peripheral surface of the photosensitive drum 131 is charged uniformly, electrostatically by the charging apparatus 132 to plus several-hundred V (normally; about 600 V), and then, the region where an electrostatic latent image is formed is discharged to plus several-dozen V (normally, about 20 V) by photoirradiation by the exposure device 133.

The developing device 134 allows deposition of toner particles in the region where the electrostatic latent image is formed, by supplying the toner particles to the peripheral surface of the photosensitive drum 131. Deposition of the toner particles leaves a toner image T on the peripheral surface of the photosensitive drum 131. The toner image T is charged positively.

The transfer roller 32 transfers the positively charged toner image T formed on the peripheral surface of the photosensitive drum 131 onto the transfer sheet P that is fed to the position immediately left to the photosensitive drum 131. The transfer roller 32 applies a negative electric charge, a polarity opposite to the electric charge of the toner image T, to the transfer sheet P for the transfer.

The transfer sheet P that reached the position left bottom to the photosensitive drum 131 is held between the transfer roller 32 and the photosensitive drum 131 under pressure and charged into a negatively charged state, and the positively charged toner image T on the peripheral surface of the photosensitive drum 131 is transferred thereon.

The cleaning device 135 cleans the peripheral surface of the photosensitive drum 131 after transfer. The cleaning removes the remaining toner particles and discharge products on the peripheral surface of the photosensitive drum 131. It is likely to occur that when cleaning off discharge products deposited on the electrification wire and the grid 132*c* by the electrostatically charging device 132 as described below, scattered discharge products adhere to the peripheral surface of the photosensitive drum 131. The cleaning device 135 has an abrasion roller 135*a* in contact with the peripheral surface of the photosensitive drum 131, and the residual toner particles and the discharge products deposited on the peripheral surface of the photosensitive drum 131 are separated by revolution of the abrasion roller 135*a* (i.e., while the peripheral surface of the photosensitive drum 131 being polished). The peripheral surface of the photosensitive drum 131 cleaned by the cleaning device 135 advances, back to the electrostatically charging device 132 for the next image formation.

The fixing unit 14 is a unit fixing the toner image T on a transfer sheet P transferred by the image forming unit 13 by heating, and has a fixing roller 141 for heating the transfer sheet P and a pressurizing unit 142 placed at the left position facing the fixing roller 141.

The transfer sheet P after transfer is fed into the nip area formed between the fixing roller 141 and the pressurizing unit 142 and fixed by the heat from the fixing roller 141, while conveyed through the nip area. The transfer sheet P after fixing is discharged along the sheet discharge route 143 into the sheet discharge unit 15.

The sheet discharge unit 15 is formed, as the top surface of the apparatus housing 11 is dented, and a sheet output tray 151 receiving the discharged transfer sheet P is formed on the bottom of the dent.

In the present embodiment, an air fan 16 with a filter 161 for supply of external air and an air supply duct 17 guiding the external air supplied through the filter 161 by the air fan 16 into the photosensitive drum unit 20 are formed at the right top position in the apparatus housing 11 in FIG. 1.

The external air supplied through the air supply duct 17 into the photosensitive drum unit 20 by the air fan 16 passes through the photosensitive drum unit 20. The air flow removes humidity in the photosensitive drum unit 20 and suppresses generation of the discharge products, and also, cools the photosensitive drum unit 20 if the photosensitive drum unit 20 inside is over-heated by a heater not shown in the Figure provided in the photosensitive drum 131. In addition, the air flow discharges scattered dust, such as the dust generated by cleaning of the electrification wire and grid 132*c* having deposited discharge products with the air flow, out of the photosensitive drum unit 20.

Figure 2:
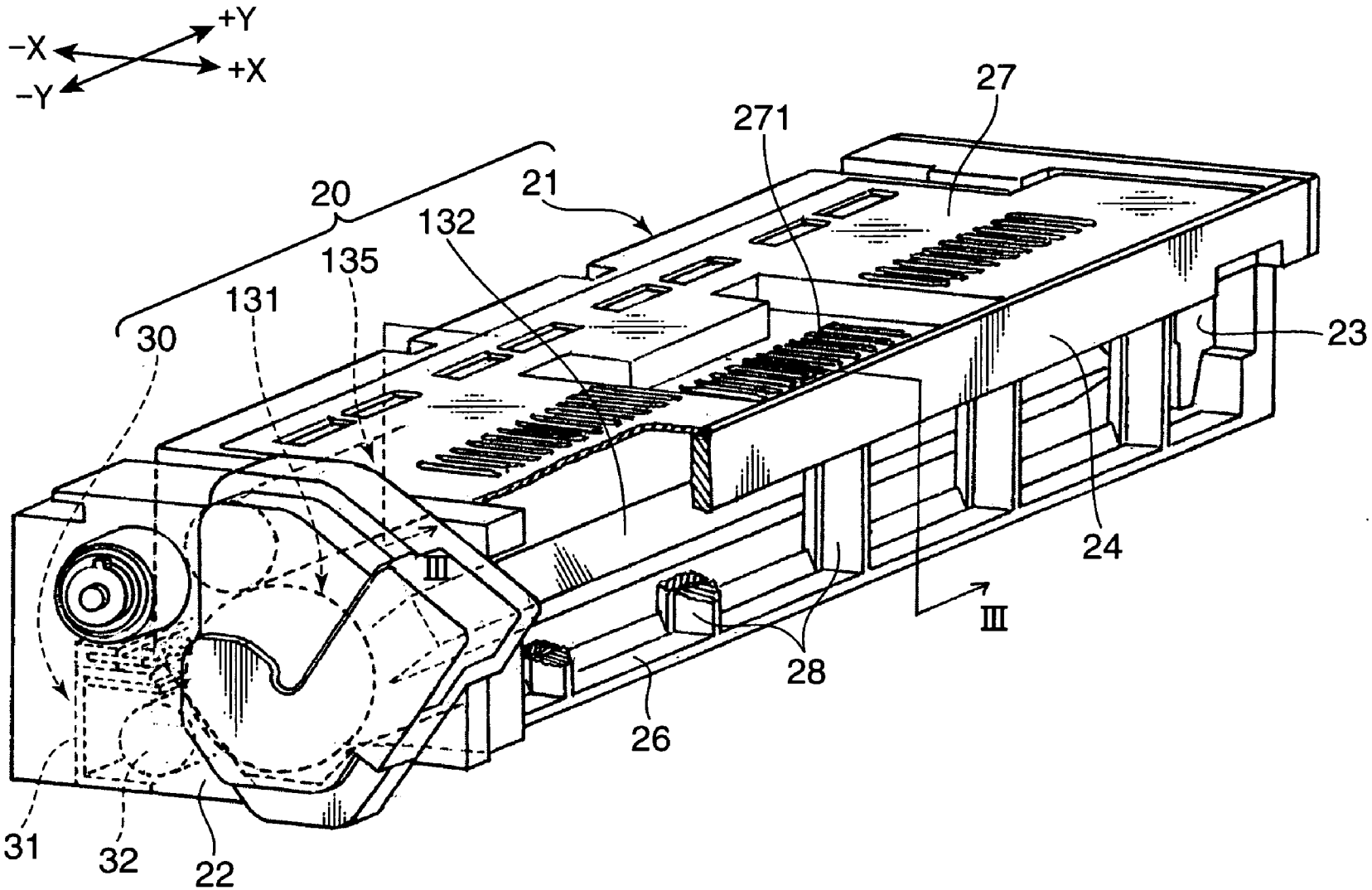
FIG. 2 is a perspective view illustrating the photosensitive drum unit in an embodiment.
Figure 3:
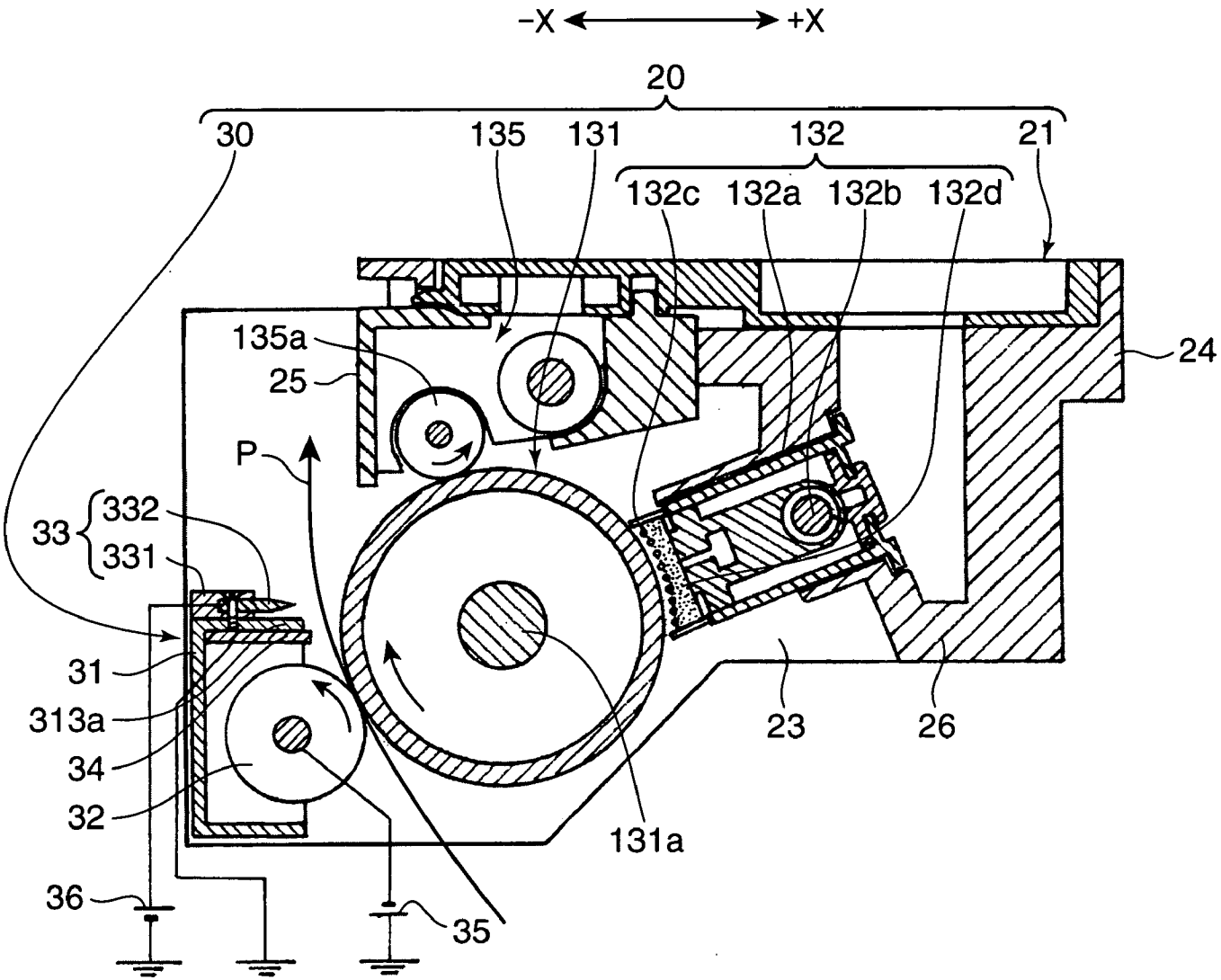
FIG. 3 is a sectional view of the device shown in FIG. 2 along the line III-III.

FIG. 2 is a perspective view illustrating the photosensitive drum unit 20 in a particular embodiment. FIG. 3 is a sectional view of the drum unit in FIG. 2 along the line III-III. In FIGS. 2 and 3, the X-X direction will be called left/right direction and the Y-Y direction, forward/backward direction; and in particular, the −X direction will be called left direction, the +X direction, right direction; the −Y direction, forward direction; and the +Y direction, backward direction.

As shown in FIG. 2, the photosensitive drum unit 20 contains a photosensitive drum 131, an electrostatically charging device 132, a transfer member 30, and a cleaning device 135 provided in a box-shaped housing 21 longer in the forward/backward direction.

The housing 21 has a rectangular front plate 22, a rear plate 23 placed backward at the position facing the front plate 22, a right-side plate 24 placed between the front plate 22 and the rear plate 23 in the top right direction, a left-side plate 25 placed between the front plate 22 and the rear plate 23 in the top left direction (FIG. 3), a bottom plate 26 placed between the front plate 22 and the rear plate 23 in the bottom right direction, and a top plate 27 closing the top surface opening. Between the right-side plate 24 and the bottom plate 26, there are multiple pillars 28 formed at the same pitch over the entire length in the forward/backward direction for improvement of the strength of the housing 21.

The bottom surface of the housing 21 to the left of the bottom plate 26 is vacant, and the light emitted from the exposure device 133 (FIG. 1) irradiates the peripheral surface of the photosensitive drum 131. The front plate 22 and the rear plate 23 extend to the left direction from the photosensitive drum 131, and a transfer member 30 is provided at the position below the center of the extending front plate 22 and rear plate 23.

By the presence of the transfer member 30 at the position, the transfer sheet P fed from the sheet cassette 121 is conveyed vertically in the upward direction (specifically, slightly inclined from the upward direction) and the toner image T on the peripheral surface of the photosensitive drum 131 is transferred thereon by action of the transfer member 30.

At the position to the right of the top plate 27, a grid window 271 consisting of multiple lattice-shaped slots is formed at the same pitch over entire length in the forward/backward direction. The external air fed from the air fan 16 (FIG. 1) through the air supply duct 17 (indicated by an arrow in FIG. 1) is supplied through the grid window 271 into the housing 21, used for cooling inside the housing 21, and discharged through various openings here and there out of the apparatus housing 11.

The photosensitive drum 131 is supported rotatably around the drum shaft 131*a* (FIG. 3) provided between the front plate 22 and the rear plate 23 in the left bottom region, and revolves clockwise in FIG. 3 as driven by a drum motor not shown in the Figure.

The cleaning device 135 is placed immediately above the photosensitive drum 131 in the housing 21. An abrasion roller 135*a* revolves at a peripheral speed higher than that of the photosensitive drum 131 in the direction opposite to that of the photosensitive drum 131 (counterclockwise in FIG. 3), while abrading the peripheral surface of the photosensitive drum 131 with its peripheral surface. The peripheral surface of the photosensitive drum 131 is polished by the difference in peripheral speed, and the discharge products deposited on the peripheral surface are removed.

The electrostatically charging device 132 is provided in the almost center of the housing 21 while it is extending in the forward/backward direction, with its discharge plane facing the peripheral surface of the photosensitive drum 131. The electrostatically charging device 132 has a shield case 132*a* longer in the forward/backward direction that has an opening facing the peripheral surface of the photosensitive drum 131, a spiral rod 132*b* internally provided as it extends in the forward/backward direction of the shield case 132*a*, an electrification wire and multiple grids 132*c* extending on the opening plane in the forward/backward direction, and a cleaning member 132*d* connected to the spiral rod 132*b* that cleans the electrification wire and the grids 132*c* by the movement caused by revolution of the spiral rod 132*b* around its shaft center.

For example, the distance between the grid 132*c* and the peripheral surface of the photosensitive drum 131 may be adjusted to 0.5 to 0.6 mm. Uniform electric charge is applied on the peripheral surface of the photosensitive drum 131, by application of high voltage (e.g., 600 V) to the electrification wire from a power supply not shown in the Figure and the resulting discharge from the wire to the peripheral surface of the photosensitive drum 131. In addition, foreign materials such as discharge products deposited on the electrification wire and grids 132*c* are removed as needed, by shaking the cleaning member 132*d* in the forward/backward direction (direction perpendicular to the sheet of FIG. 3) by revolution of the spiral rod 132*b* around the shaft center.

Figure 4:
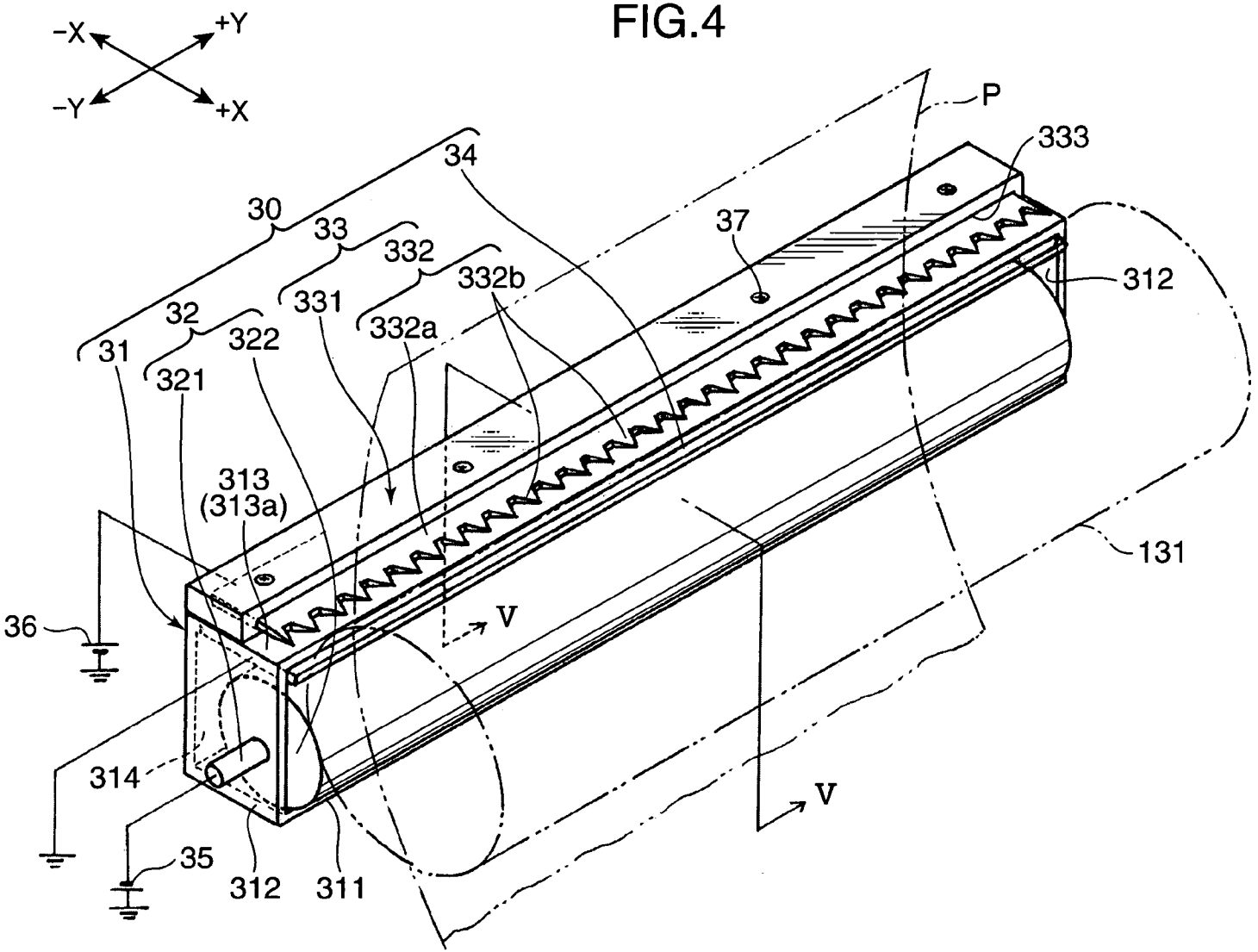
FIG. 4 is a perspective view illustrating the transfer member in an embodiment.
Figure 5:
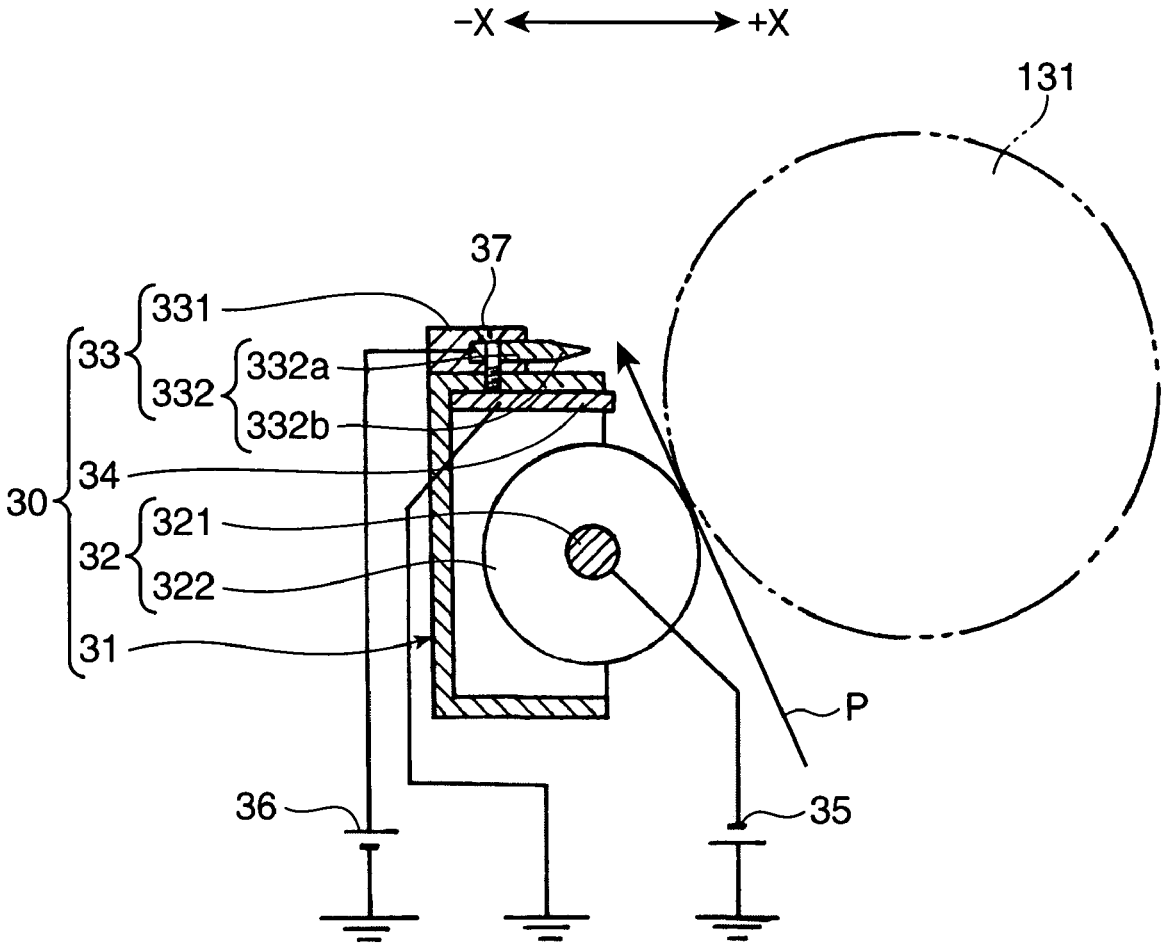
FIG. 5 is a sectional view of the transfer member shown in FIG. 4 along the line V-V.

FIG. 4 is a perspective view illustrating the transfer member 30 in an embodiment, and FIG. 5 is a sectional view thereof along the ling V-V in FIG. 4. In FIGS. 4 and 5, the directions expressed with X and Y are the same as those in FIG. 2 [X: left/right direction (−X: left direction, +X: right direction), Y: forward/backward direction (−Y: forward direction, +Y: backward direction)].

As shown in FIG. 4, the transfer member 30 has a casing 31 long rectangular in the forward/backward direction with its right opening facing the left side of the peripheral surface of the photosensitive drum 131, a transfer roller (transfer member) 32 placed inside the casing 31, a static charge eliminator 33 connected to the casing 31, and a conductive member 34 provided between the static charge eliminator 33 and the transfer roller 32 inside the casing 31.

The casing 31 is prepared by using an insulating hard synthetic resin as its raw material, and the length thereof in the forward/backward direction is adjusted to be almost the same as that of the photosensitive drum 131. The casing 31 has a bottom plate 311 long rectangular in the forward/backward direction, a pair of side plates 312 provided at the front and rear edges of the bottom plate 311, a top plate 313 provided between the edges of the pair of side plates 312, a left plate 314 provided between the left edges of the pair of side plate 312. There is a roller-incorporating space for accommodation a transfer roller 32 in the casing 31.

The top plate 313 in the almost right half region (insulating member 313*a*) functions as the insulating member (provided between the static charge eliminator and the conductive member) in the claimed invention.

The transfer roller 32 is designed to have a length identical with or slightly shorter than the length of the photosensitive drum 131.

The transfer roller 32 has a roller shaft 321 in parallel with the drum shaft 131*a* of the photosensitive drum 131 (FIG. 3) and a transfer roller main body 322 concentric with the roller shaft 321 and integrated rotatably around it. The transfer roller main body 322 is made of an elastic insulating material such as synthetic rubber. Negative voltage is applied to the transfer roller 32 from a first power supply 35 placed at a suitable position in the apparatus housing 11.

The transfer sheet P is conveyed into the nip area between the transfer roller main body 322 and the peripheral surface of the photosensitive drum 131, as it is kept in contact with the peripheral surface of the transfer roller main body 322. Then as shown in FIG. 6, the positively charged toner image T is adsorbed on the surface of the negatively charged transfer sheet P electrostatically. Thus, the toner image T formed on the peripheral surface of the photosensitive drum 131 is transferred onto the transfer sheet P.

The transfer roller 32 is provided rotatably around the roller shaft 321 in the casing 31, with the front and rear terminals of the roller shaft 321 respectively penetrating the casing 31 side plates 312 in the left/right direction position, at the positions middle in the vertical direction. Part of the peripheral surface of the transfer roller 32 extends out of the casing 31 in the left/right direction and the peripheral surface is brought into contact with the peripheral surface of the photosensitive drum 131 under pressure.

The static charge eliminator 33 has a pedestal member 331 fixed at a position leftward on the top plate 313 of the casing 31 and charge-eliminating teeth 332 provided on the pedestal member 331. The pedestal member 331 is made flat with an insulating material such as hard synthetic resin and designed to have a length in the forward/backward direction almost the same as that of casing 31 and a left-right width almost half of that of the casing 31.

The pedestal member 331 has, on its right edge surface, a long attachment hole 333 (see FIG. 4) long in the forward/backward direction and dent in the leftward direction for attachment of the charge-eliminating teeth 332. Screws 37 are inserted into through-holes not shown in the Figure formed in the pedestal member 331 and charge-eliminating teeth 332, while the charge-eliminating teeth 332 is inserted into the long attachment hole 333. The screws 37 are connected and tightened to screw holes not shown in the Figure and formed in the top plate 313 of the casing 31. Thus, both the pedestal member 331 and the charge-eliminating teeth 332 (i.e., static charge eliminator 33) are connected to the casing 31.

The charge-eliminating teeth 332 function as an electrode for applying an electric field E (FIG. 6) to the space between the charge-eliminating teeth 332 and the peripheral surface of the photosensitive drum 131. The charge-eliminating teeth 332 is made of a metal material such as copper or aluminum, and has a proximal end plate 332*a* inserted into the long attachment hole 333 of the pedestal member 331 and multiple saw teeth-shaped charge-eliminating teeth 332*b* extending at the same pitch from the edge of the proximal end plate 332*a* in the right direction toward the right direction.

Each charge-eliminating tooth 332*b*, an isosceles triangle in its planer view, faces the peripheral surface of the photosensitive drum 131 in the vertex region (edge). The distance of each charge-eliminating tooth 332*b* from the proximal end plate 332*a* is so adjusted that the edge thereof is slightly retracted in the left/right direction from the right edge of the casing 31 top plate 313. Positive voltage is applied to the charge-eliminating teeth 332 from a second power supply 36. Thus as shown in FIG. 6, an electric field E is formed in the space surrounding the charge-eliminating teeth 332*b* when the voltage is applied to the charge-eliminating teeth 332 from the second power supply 36.

The conductive member 34 is a device to perform so-called electrostatic neutralization by guiding the formed electric field E in the area surrounding the edge of the charge-eliminating teeth 332*b* and thus making the toner image T transferred on the transfer sheet P separable more easily from the peripheral surface of the photosensitive drum 131. The conductive member 34 is, for example, a conductive cloth prepared by weaving an electrically conductive fiber. An example of the conductive cloth is a sealed gasket, an elastic sealing part covered with a conductive cloth, (trade name: "Sealed Tight", part name: "STG0.5-08", manufactured by Takeuchi Kogyo K.K.)

The conductive member 34 is designed to have a length in the forward/backward direction almost the same as the internal dimension between a pair of side plates 312 of the casing 31 and a thickness almost the same as that of the charge-eliminating teeth 332. The conductive member 34 is fixed to the casing 31 as it is adhered to the rear surface of the top plate 313 with a particular adhesive, while its right edge is slightly extending out of the top plate 313 of the casing 31 (i.e., insulating member 313*a*) in the rightward direction.

As shown in FIG. 6, the distance of the conductive member 34 from the top plate 313 is so adjusted that the right top edge of the conductive member 34 (point C) is located at the extension of the line L connecting between the edge of the charge-eliminating teeth 332*b* (point A) and the right top edge of the insulating member 313*a* (point B). In this way, the electric field E generated from the edge of each charge-eliminating tooth 332*b* as the initial point is guided to the conductive member 34 properly, applying the electric field to the space containing the transfer sheet P in the circular arc shape. Thus, the electric field E functions more effectively to separate the toner image T transferred on the transfer sheet P from the peripheral surface of the photosensitive drum 131.

As for the conductivity of the conductive member 34, the conductive member 34 preferably has a surface resistivity of 0.1Ω/□ or less (□ is a symbol indicating "square"). When the surface resistivity of the conductive member 34 is more than 0.1Ω/□, it often becomes difficult to form a loop-shaped electric field E from the edge of the charge-eliminating teeth 332*b* to the edge of the conductive member 34 and apply the electric field effectively to the toner image T on a transfer sheet P. A favorable surface resistivity of the conductive member 34 is approximately 0.06Ω/□. In the present embodiment, the conductive member 34 is grounded, and thus, the electric potential of the conductive member 34 is adjusted to the ground level (±0 V).

FIG. 6 is a partially expanded view of FIG. 5, explaining the function of the transfer member 30. The directions indicated by X in FIG. 6 are the same as those in FIG. 2 (−X: left direction, +X: right direction). In FIG. 6, the thickness of the transfer sheet P is shown as exaggerated.

As shown in FIG. 6, the positively charged toner image T formed on the peripheral surface of the photosensitive drum 131 (indicated by + in circle) is connected to the peripheral surface of the photosensitive drum 131 electrostatically until it reaches the position facing the peripheral surface of the transfer roller main body 322 while the transfer sheet P is held between the photosensitive drum 131 and the transfer roller 32.

The peripheral surface of the photosensitive drum 131 is charged entirely to a high positive voltage (about 600 volt) by electrification by the electrostatically charging device 132. An electrostatic latent image is formed on the peripheral surface of the photosensitive drum 131 in the state, by photoirradiation by the exposure device 133, but the electrostatic potential of the region carrying the electrostatic latent image is reduced to several-dozen V. Because positively charged toner particles are supplied to the peripheral surface of the photosensitive drum 131 from the developing device 134 in such a state, in electrostatic interaction between the regions higher and lower in electric potential, the positively charged toner particles adheres to the electrostatic latent image, a region lower in electric potential, forming a toner image T.

As for the positive electric charge formed on the peripheral surface of the photosensitive drum 131 In FIG. 6, the electric charge in the region lower in electric potential where an electrostatic latent image is formed is expressed with thin "+", while the region other than that higher in electric potential, with bald "+".

When the toner image reaches the transfer sheet P held between the photosensitive drum 131 and the transfer roller main body 322 by revolution of the photosensitive drum 131, the transfer sheet P is charged negatively on the surface side (right direction) by the negative electric charge of the peripheral surface of the transfer roller main body 322. Thus, the positively charged toner image T on the peripheral surface of the photosensitive drum 131 is electrostatically adsorbed onto the surface of the negatively charged transfer sheet P.

Then, when the transfer sheet P advances by revolution of the photosensitive drum 131 in the state without the static charge eliminator 33 provided, the transfer sheet P negatively charged on the surface side may be wound to the photosensitive drum 131, as it adheres to the peripheral surface of the positively charged photosensitive drum 131.

In the present embodiment, to avoid such a problem, a static charge eliminator 33 is provided at the position immediately above the transfer roller 32 (immediately downstream position), and an electric field E is generated in the space including the transfer sheet P, in the direction from the edges of the charge-eliminating teeth **332*b* to the conductive member 34. Thus by providing a conductive member 34 between the static charge eliminator 33 and the transfer roller 32, the electric field E applied from the charge-eliminating teeth 332*b* is oriented toward the conductive member 34, and acts on the transfer sheet P at a position closer to the transfer roller 32**.

Accordingly, immediately after the transfer sheet P is fed into the nip area between the photosensitive drum 131 and the transfer roller 32, the transfer sheet P comes into the electric field E formed by the static charge eliminator 33. Thus, the negative electric charge formed on the rear surface of the transfer sheet P is eliminated by the electric field E; the adsorption force between the transfer sheet P and the photosensitive drum 131 is lowered; and as a result, the transfer sheet P is positively charged as a whole. When the transfer sheet P is charged positively as a whole, the positive charge on the transfer sheet P and the positive charge on the toner image T encounter each other on the peripheral surface of the photosensitive drum 131. Consequently, the transfer sheet P is separated from the peripheral surface of the photosensitive drum 131, and, as a result, it is possible to avoid the problem of the transfer sheet P winding around the peripheral surface of the photosensitive drum 131.

As described in detail, in the present embodiment the printer 10 has a photosensitive drum 131 carrying a toner image T formed by electrostatic adsorption, a transfer roller 32 facing the surface of the photosensitive drum 131 for transferring the toner image T electrostatically onto a transfer sheet, a charge eliminator 33 for generating an electric field E for separation of the transfer sheet P carrying the transferred toner image T from the electrostatically photosensitive drum 131, and a conductive member 34 for orienting the electric field E generated between the static charge eliminator 33 and the transfer roller 32 to the position close to the transfer roller 32.

In the printer 10 in such a configuration, when the toner image T formed on the surface of the photosensitive drum 131 reaches the position facing the transfer roller 32 by revolution of the photosensitive drum 131, it is separated from the surface of the photosensitive drum 131 by the electrostatic action of the transfer roller 32 and transferred onto the transfer sheet P fed into the nip portion between the photosensitive drum 131 and the transfer roller 32.

The transfer sheet P carrying the transferred toner image T often adheres to the revolving photosensitive drum 131 on the toner image T. However by the action of the electric field E generated by the static charge eliminator 33, the toner image T on the transfer sheet P is electrostatically forced to move in the direction for separation from the surface of the photosensitive drum 131.

In addition, because there is a conductive member 34 provided between the static charge eliminator 33 and the transfer roller 32, the electric field E generated by the static charge eliminator 33 is oriented toward the conductive member 34. The conductive member 34 also prohibits electrical short circuiting (or discharge) from the charge-eliminating teeth **332*b* to the transfer roller 32, thus, allowing effective exposure of the transfer sheet P to the electric field E. The toner image T transferred on the transfer sheet P is exposed to the electric field E efficiently, and thus, the transfer sheet P carrying the toner image T is separated from the photosensitive drum 131** reliably.

There is an insulating member **313*a* provided between the static charge eliminator 33 and the conductive member 34. Thus, it is possible to prevent application of the electric field E generated by the static charge eliminator 33 via the shortest path to the conductive member 34. Thus, the electric field E is generated in such a manner that it advances from the edge of the static charge eliminator 33 to the edge of the conductive member 34 into the nip portion between the photosensitive drum 131 and the transfer roller 32 facing each other in an arc-shaped pattern. As a result, the transfer sheet P can be exposed to the electric field E to the maximum degree, allowing reliable separation of the transfer sheet P from the surface of the photosensitive drum 131**.

The distance between the edge of static charge eliminator 33 and the transfer sheet P is made longer than the distance between the edge of conductive member 34 and the transfer sheet P, and the insulating member **313*a* is provided at a position where its edge is located almost on the straight line drawn between the edge of static charge eliminator 33 and the edge of the conductive member 34. Thus, it is possible to prevent excessive advancement of the edge of the insulating member 313*a* to the photosensitive drum 131. If it approaches too excessively, the electric field E from the static charge eliminator 33 does not advance to the edge of the conductive member 34 as it is blocked by the insulating member 313*a*, causing a problem that it is difficult to form a suitable electric field E between the static charge eliminator 33** and the charge eliminator.

An embodiment of the present invention has been described so far above, but the present invention is not limited to the embodiment and includes the following embodiments:

(1) A printer 10 was exemplified as the image forming apparatus in the embodiment above. In addition, the present invention is applicable to copying machines reading an image and reproducing the image on a transfer sheet, facsimile apparatuses performing image forming processing, based on image information transmitted from the counterpart, and others.

(2) An integrated photosensitive drum unit 20 containing a photosensitive drum 131, an electrostatically charging device 132, a transfer member 30 and a cleaning device 135 was used as an example in the embodiment above. Each component may be provided separately in the apparatus housing 11 without integration.

(3) A photosensitive drum 131 was exemplified as the image bearing member in the embodiment. In addition, the image bearing member may be, for example, a photosensitive belt stretched rotatably around multiple rollers that allows formation of an electrostatic latent and a toner image T on the surface.

(4) A wire-shaped charging device having an electrification wire and grids 132*c* was exemplified as the electrostatically charging device 132 in the embodiment. A so-called electrification roller revolving with its peripheral surface in contact with the peripheral surface of the photosensitive drum 131 may be used as the electrostatically charging device instead.

(5) A transfer roller 32 was exemplified as the transfer member according to the invention in the embodiment, but a transfer member having a wire for discharge by the discharge method may be used instead.

(6) A gasket prepared by covering a synthetic resin of an elastic material with a conductive cloth was exemplified as the conductive member 34 in the embodiment. The gasket may be, for example, a conductive nonwoven fabric, a so-called aluminum tape of a synthetic resin having an aluminum surface film formed by vapor deposition, a common metal plate or a synthetic resin sheet prepared by using a conductive resin such as polyvinylbenzyl cation or polyacetic acid cation, or the like.

(7) A so-called vertically conveying system in which the transfer sheet P is conveyed to the photosensitive drum 131 upward in the vertical direction was used in the embodiment above, but a so-called horizontally conveying system in which the transfer sheet P is conveyed horizontally to the photosensitive drum may be used in stead.

Figure 7:
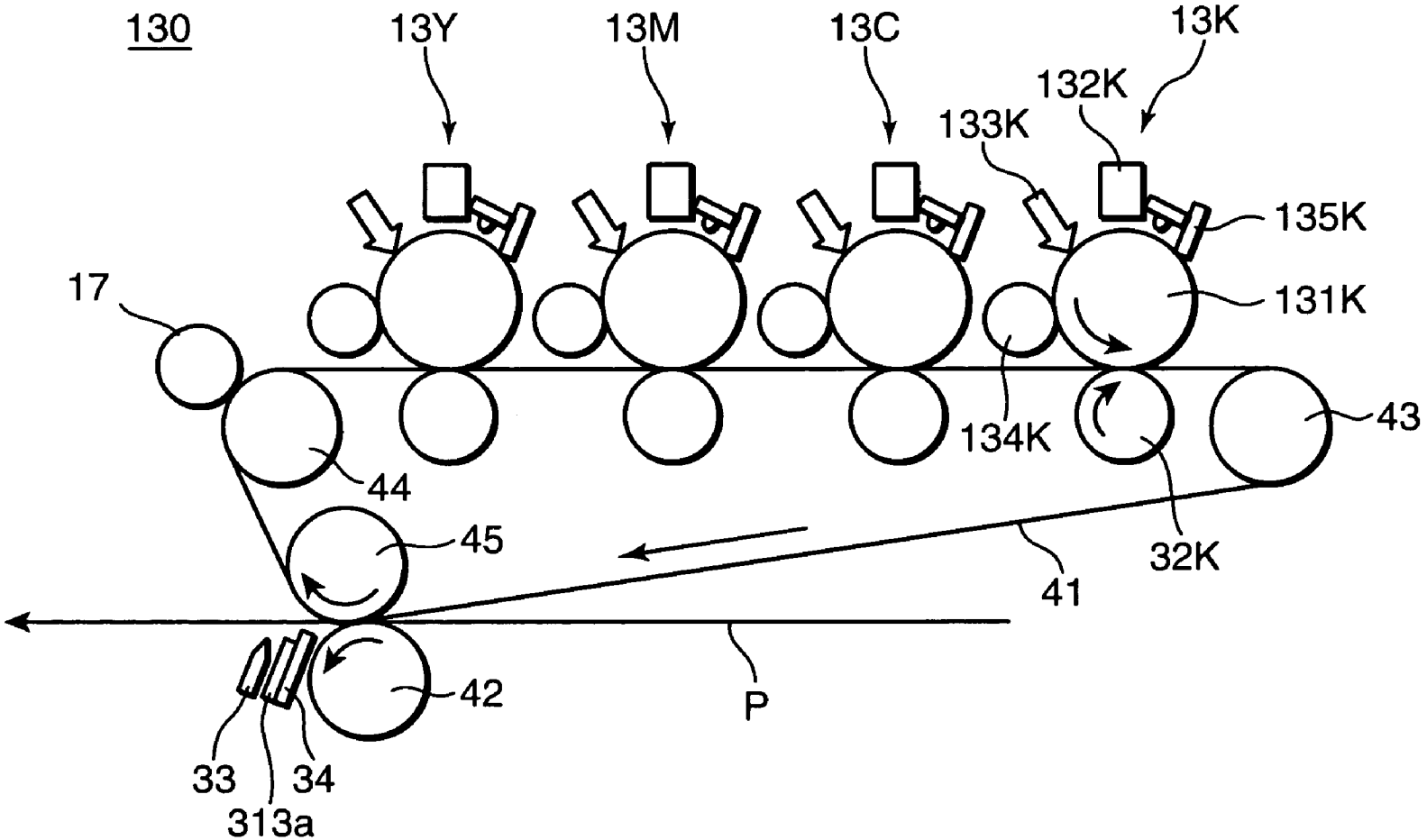
FIG. 7 is a schematic front sectional view illustrating the image forming unit in a tandem color printer in another modified embodiment.

(8) The image bearing member may be an intermediate transfer belt that is used, for example, in tandem color printers. FIG. 7 is a schematic front sectional view illustrating the image forming unit 130 in a tandem color printer. The image forming unit 130 has an yellow unit 13Y, a magenta unit 13M, a cyan unit 13C and a black unit 13K provided in tandem.

For example, the black unit 13K has a photosensitive drum 131K, and an electrostatically charging device 132K, a exposure device 133K, a developing device 134K and a cleaning device 135K placed around it, and also a primary transfer roller 32K at the position immediately below the photosensitive drum 131K. The other units 13Y, 13M and 13C have the same configuration.

The color toner images formed in respective units 13Y, 13M, 13C and 13K are transferred onto the intermediate transfer belt 41 one by one. The intermediate transfer belt 41 is an endless elastic belt that is stretched rotatably around a drive roller 43, a dependent roller 44 and a backup roller 45 in contact with the peripheral surface of the photosensitive drums of respective unit 13Y, 13M, 13C and 13K. There is a secondary transfer roller 42 (transfer member) facing the backup roller 45 on the other side of the intermediate transfer belt 41. The color toner images superimposed by respective units on the intermediate transfer belt 41 is secondarily transferred onto a transfer sheet P fed into the nip area between the secondary transfer roller 42 and the backup roller 45.

As shown in FIG. 7, when the present invention is applied to such a tandem color printer, the static charge eliminator 33 (charge-eliminating teeth 332), the conductive member 34 and the insulating member 313*a* described above are favorably provided downstream of the secondary transfer roller 42 in the sheet conveying direction. The invention in the configuration allows reliable separation of the transfer sheet P from the surface of the intermediate transfer belt 41.

[Confirmation Test]

In examining the material favorable for the conductive member 34, various materials properly selected was placed respectively, actually on a casing 31, and confirmation tests for examining whether the transfer sheet P adheres to the photosensitive drum 131 were performed in a printer 10.

Used as the samples of conductive member 34 were an aluminum tape having a synthetic resin sheet and an aluminum layer deposited on the synthetic resin sheet, a nonwoven fabric of conductive material, gaskets manufactured by Takeuchi Kogyo K.K. (trade name: "Shield Tight"), a ultra-high polymer PE (polyethylene) sheet, a polymer PE sheet and a Teflon sheet (sheet made of polytetrafluoroethylene). In particular, a gasket "1" having a surface resistance of 0.05Ω/□, a gasket "2" of 0.06Ω/□, a gasket "3" of 0.06Ω/□, and a gasket "4" of 0.10Ω/□ were chosen. The gasket "2" was a woven fabric of a conductive fiber, while the gasket "3" was a nonwoven fabric with a metal foil.

Each sample was provided in an actual printer 10 as its conductive member 34, and 50 transfer sheets were subjected to printing on both sides. Winding of the transfer sheet P on the photosensitive drum 131 (whether the conveyance of the transfer sheet P is favorable) was examined, while transfer of image on each transfer sheet P was observed visually. The results in the confirmation tests are summarized in table 1.

TABLE 1

| CONDUCTIVE MEMBER | | |
|---|---|---|
| MATERIAL | SURFACE RESISTIVITY (Ω/□) | TEST RESULT |
| ALUMINUM TAPE | 0.04 | ○ |
| NONWOVEN FABRIC | | ◎ |
| GASKET [1] | 0.05 | ○ |
| GASKET [2] | 0.06 | ○ |
| GASKET [3] | 0.06 | Δ |
| GASKET [4] | 0.10 | Δ |
| ULTRAHIGH-MOLECULAR | | |
| POLYMER PE SHEET | $10^1$ | X |
| POLYMER PE SHEET | $10^4$ | X |
| TEFLON SHEET | ∞ | X |

NOTE:
◎: NO CONVEYING TROUBLE ON 50/50 SHEETS
○: SLIGHT CONVEYING TROUBLES IN 10/50 SHEETS
Δ: SLIGHTLY SERIOUS CONVEYING TROUBLES IN 20/50 SHEETS
X: SERIOUS CONVEYING TROUBLES IN 40/50 SHEETS

As shown in table 1, all 50 transfer sheets were conveyed favorably without adhesion to the photosensitive drum 131 with the nonwoven fabric (◎ "no conveying defect in 50/50 sheets" in table 1). Alternatively, 10 transfer sheets out of 50 transfer sheets P were attracted slightly to the photosensitive drum 131, but not to the degree of adhesion with the aluminum tape and the gaskets "1" and "2" (○"slight conveying defect in 10/50 sheets" in table 1).

In contrast, 20 transfer sheets out of 50 transfer sheets P were attracted significantly strongly to the photosensitive drum 131, causing possible sheet jamming, but not to the degree causing actual troubles in transfer processing with the gaskets "3" and "4". Thus, it can still be applicable to actual image formation (Δ "slightly serious conveying troubles in 20/50 sheets" in table 1).

Further, 40 transfer sheets out of 50 transfer sheets caused conveying defect associated with a sheet jamming, with the ultrahigh polymer PE sheet, the polymer PE sheet and the Teflon sheet, which are further higher in surface resistance (x: "serious conveying troubles in 40/50 sheets" in table 1).

As apparent from table 1, a conductive member having a smaller surface resistance is less likely to cause conveying defect.

Nonwoven fabrics were completely resistant to adhesion to the photosensitive drum 131 and the effect was most favorable, but, as the filaments were exposed on the surface, there was some local fluctuation in forming electric field in the longitudinal direction of the nonwoven fabric, and use of the nonwoven fabrics was unreliable for that reason. Specifically, when a nonwoven fabric is used, the toner particles in the toner image T on the peripheral surface of the photosensitive drum 131 in the region not locally discharged remains on the peripheral surface of the photosensitive drum 131, and, as a result, caused image defects such as white line on the image-transferred transfer sheet P. Accordingly, there is a need for improvement in that point, when a nonwoven fabric is used as the conductive member 34.

For the reasons above, gaskets are considered to be most preferable as the materials for the conductive member 34.

In addition, a test for examining whether there is difference in the resistance of the transfer sheet P to adhesion to the photosensitive drum 131, among when a particular bias voltage is applied to the conductive member 34, when the conductive member 34 is simply grounded, and when the conductive member 34 was brought into an electrically floating state (no voltage applied or grounded). The results showed that the grounded state, the float state, and the voltage-applied state were effective in that order.

The typical embodiments described above include an invention in the following configuration:

An aspect of the present invention is an image forming apparatus, comprising:

a revolvable image bearing member on which a toner image is formed;

a transfer member provided against a surface of the image bearing member for transferring the toner image electrostatically on a transfer sheet traveling between the image bearing member and the transfer member;

a static charge eliminator generating an electric field to remove electric charges on the transfer sheet for separation of the transfer sheet carrying the transferred toner image from the image bearing member; and a conductive member provided between the static charge eliminator and the transfer member.

The term "revolution" is a concept that something revolves around something, and applies to an object moving along multiple rollers in the state as stretched around the rollers as an endless belt and also revolving around a particular shaft center.

In the configuration above, the toner image formed on the image bearing member is separated from the surface of the image bearing member by the electrostatic action of the transfer member when it reaches the position facing the transfer member by revolution of the image bearing member and transferred on a transfer sheet fed into the nip portion between the image bearing member and the transfer member.

The transfer sheet carrying the transferred toner image is then in the state adhering to the revolving image bearing member via the toner image. However, by discharging action by the static charge eliminator for separation of the transfer sheet from the image bearing member electrostatically, the transfer sheet receives an electrostatic force in the direction that it is separated from the image bearing member surface.

Because there is a conductive member provided between the static charge eliminator and the transfer member, the electric field formed by the static charge eliminator orient itself to the direction toward the conductive member. Thus, absence of short circuiting form the static charge eliminator to the transfer member by discharging makes the transfer sheet exposed effectively to the electric field at a position closer to the transfer member. Thus, the sheet image becomes more sensitive to the action of the electric field generated by the static charge eliminator and separated from the image bearing member more reliably.

Preferably in the configuration, there is an insulating member provided between the static charge eliminator and the conductive member. In the configuration, the insulating member prevents the electric field formed by the static charge eliminator from advancing to the conductive member via the shortest-distance route. Thus, the electric field advances to the edge of the conductive member from the edge of the static charge eliminator in an arc-shaped pattern in the nip portion between the image bearing member and the transfer member facing each other, allowing exposure of the transfer sheet to the electric field to the maximum degree and thus, reliable separation of the image bearing member from the surface.

Preferably in such a case, the image forming apparatus has a casing made of an insulating material that has a space for accommodation of the transfer member. The static charge eliminator and the conductive member are arranged in such a way to sandwich a part of the casing. In the configuration, by using the casing for accommodation of transfer member, it is possible to place a conductive member between the static charge eliminator and the conductive member and simplify the configuration.

Preferably in the configuration, the distance between the edge of the static charge eliminator and the transfer sheet is made longer than the distance between the edge of the conductive member and the transfer sheet, and the edge of the insulating member is designed to be almost on the straight line connecting the edge of the static charge eliminator and the edge of the conductive member.

In the configuration, it is possible to prevent, the edge of the insulating member from approaching the image bearing member excessively closer. Thus, it is possible to prevent the trouble that the electric field from the static charge eliminator is blocked by the insulating member and does not reach the edge of the conductive member, i.e., the trouble of a suitable electric field not being formed between the static charge eliminator and the conductive member.

Preferably in the configuration above, the conductive member contains a conductive cloth having a surface resistivity of 0.1Ω/□ or less. In the configuration above, a desirable electric field is formed between the static charge eliminator and the conductive member. When the surface resistivity of the conductive member is more than 0.1Ω/□, the desirable electric field may not be formed. The fact is supported by many test results. The material for the conductive member having a surface resistivity of 0.1Ω/□ or less is preferably a conductive cloth.

Preferably in the configuration, the image bearing member and the transfer member are provided in positions facing each other in such a manner that the transfer processing is performed on the transfer sheet conveyed upward in the vertical direction.

In the case of vertical conveyance direction, the image bearing member and the transfer member should be placed side-by-side at positions at the same height, but in such a layout, the edge of the transfer sheet fed upward from the bottom coming out of the nip portion between the image bearing member and the transfer member after transfer processing may become unstabilized and uneven in the traverse direction. When the transfer sheet is conveyed in the horizontal direction, the edge of the transfer sheet moves in the direction separating from the image bearing member placed above by the downward force by gravity, but when the transfer sheet is conveyed in the vertical direction, there is no gravity forcing the edge of a transfer sheet into the direction separating from the image bearing member. Thus, conveyance in the vertical direction leads to a problem of the transfer sheet easily adhering to the image bearing member. However in the present invention, the transfer sheet winding around the image bearing member is pulled back forcibly by action of the static charge eliminator, and the transfer sheet is resistant to winding around the image bearing member, even if there is no gravitational action, i.e., even if it is not an image forming apparatus configured to perform transfer processing while the transfer sheet is conveyed horizontally.

Preferably in the configuration above, the static charge eliminator has saw teeth-shaped multiple charge-eliminating teeth formed at the same pitch.

In the configuration, it is possible to apply a uniform electric field to the transfer sheet more easily.

Preferably in the configuration above, an electrostatic latent image is formed on the image bearing member and a toner image is formed by electrostatic adsorption of toner particles along the electrostatic latent image.

Preferably in such a case, the image bearing member is a photosensitive drum revolving around its shaft center, and the transfer member is a transfer roller revolving around its shaft center while a negative voltage is applied thereto.

Alternatively, the image bearing member includes a photosensitive belt rotating stretched around a plurality of rollers.

Yet alternatively, the image bearing member may be an intermediate transfer belt stretched rotatably around multiple rollers onto which toner images are transferred.

This application is based on patent application No. 2006-203391 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

a revolvable image bearing member on which a toner image is formed;

a transfer member provided against a surface of the image bearing member for transferring a toner image electrostatically on a transfer sheet traveling between the image bearing member and the transfer member;

a static charge eliminator operable to generate an electric field to remove the electric charge on the transfer sheet for separation of the transfer sheet carrying the transferred toner image from the image bearing member; and a conductive member provided between the static charge eliminator and the transfer member, wherein the distance between a leading edge of the static charge eliminator and the transfer sheet is made longer than the distance between a leading edge of the conductive member and the transfer sheet.

2. The image forming apparatus according to claim 1, further comprising:

a casing made of an insulating material and having a space for accommodation of the transfer member; wherein the static charge eliminator and the conductive member are arranged in such a manner as to sandwich a part of the casing.

3. The image forming apparatus according to claim 1, wherein the conductive member comprises a conductive cloth having a surface resistivity of 0.1 Ω/□ or less.

4. The image forming apparatus according to claim 1, wherein the image bearing member and the transfer member are provided against each other in such a manner that the transfer processing is performed on a transfer sheet conveyed upward in a vertical direction.

5. The image forming apparatus according to claim 1, wherein the static charge eliminator comprises saw teeth-shaped multiple charge-eliminating teeth formed at the same pitch.

6. The image forming apparatus according to claim 1, wherein an electrostatic latent image is formed on the image bearing member and a toner image is formed by electrostatic adsorption of toner particles onto the electrostatic latent image.

7. The image forming apparatus according to claim 6, wherein the image bearing member includes a photosensitive belt rotating stretched around a plurality of rollers.

8. The image forming apparatus according to claim 1, wherein the image bearing member includes an intermediate transfer belt rotatably stretched around a plurality of rollers for bearing a toner image.

9. An image forming apparatus comprising:

a revolvable image bearing member on which a toner image is formed;

a transfer member provided against a surface of the image bearing member for transferring a toner image electrostically on a transfer sheet traveling between the image bearing member and the transfer member;

a static charge eliminator operable to generate an electric field to remove the electric charge on the transfer sheet for separation of the transfer sheet carrying the transfer toner image from the image bearing member;

a conductive member provided between the static charge eliminator and the transfer member; and an insulating member provided between the static charge eliminator and the conductive member, wherein the distance between a leading edge of the static charge eliminator and the transfer sheet is made longer than the distance between a leading edge of the conductive member and the transfer sheet, and a leading edge of the insulating member is almost on a straight line connecting the leading edge of the static charge eliminator and the leading edge of the conductive member.

10. The image forming apparatus according to claim 9, further comprising:

a casing made of an insulating material and having a space for accommodation of the transfer member; wherein the static charge eliminator and the conductive member are arranged in such a manner as to sandwich a part of the casing.

11. The image forming apparatus according to claim 9, wherein the conductive member comprises a conductive cloth having a surface resistivity of 0.1 Ω/□ or less.

12. The image forming apparatus according to claim 9, wherein the image bearing member and the transfer member are provided against each other in such a manner that the transfer processing is performed on a transfer sheet conveyed upward in a vertical direction.

13. The image forming apparatus according to claim 9, wherein the static charge eliminator comprises saw teeth-shaped multiple charge-eliminating teeth formed at the same pitch.

14. The image forming apparatus according to claim 9, wherein the image bearing member includes an intermediate transfer belt rotatably stretched around a plurality of rollers for bearing a toner image.

15. An image forming apparatus comprising:

a revolvable image bearing member on which a toner image is formed, an electrostatic latent image being formed on the image bearing member and a toner image being formed by electrostatic adsorption of toner particles onto the electrostatic latent image, the image bearing member including a photosensitive drum revolving around an axis thereof;

a transfer member provided against a surface of the image bearing member for transferring the toner image electrostatically on a transfer sheet traveling between the image bearing member and the transfer member, the transfer member being a transfer roller revolving around an axis thereof while a negative voltage is applied thereto;

a static charge eliminator operable to generate an electric field to remove the electric charge on the transfer sheet for separation of the transfer sheet carrying the transferred toner image from the image bearing member; and a conductive member provided between the static charge eliminator and the transfer member.

16. The image forming apparatus according to claim 15, further comprising:

a casing made of an insulating material and having a space for accommodation of the transfer member; wherein the static charge eliminator and the conductive member are arranged in such a manner as to sandwich a part of the casing.

17. The image forming apparatus according to claim 15, wherein the conductive member comprises a conductive cloth having a surface resistivity of 0.1 Ω/□ or less.

18. The image forming apparatus according to claim 15, wherein the image bearing member and the transfer member are provided against each other in such a manner that the transfer processing is performed on a transfer sheet conveyed upward in a vertical direction.

19. The image forming apparatus according to claim 15, wherein the static charge eliminator comprises saw teeth-shaped multiple charge-eliminating teeth formed at the same pitch.

20. The image forming apparatus according to claim 15, wherein the image bearing member includes an intermediate transfer belt rotatably stretched around a plurality of rollers for bearing a toner image.

21. The image forming apparatus according to claim 15, further comprising:

an insulating member provided between the static charge eliminator and the conductive member.

* * * * *